United States Patent [19]

Mei

[11] Patent Number: 4,994,125

[45] Date of Patent: Feb. 19, 1991

[54] ELECTRIC PRIMER WITH INTRINSIC CONDUCTIVE MIX

[75] Inventor: George C. Mei, Creve Coeur, Mo.

[73] Assignee: Olin Corporation, Stamford, Conn.

[21] Appl. No.: 348,440

[22] Filed: May 8, 1989

[51] Int. Cl.[5] ..... C06B 43/00

[52] U.S. Cl. ..... 149/22; 149/42; 149/77

[58] Field of Search ..... 149/42, 77, 22

[56] References Cited

U.S. PATENT DOCUMENTS

| | | | |
|---|---|---|---|
| H 285 | 6/1987 | Downs et al. | 149/79 |
| 2,754,757 | 7/1956 | MacLeod | 102/28 |
| 2,918,871 | 12/1959 | Taylor | 102/70.2 |
| 2,942,546 | 6/1960 | Liebhafsky et al. | 102/28 |
| 3,090,310 | 5/1963 | Peet et al. | 102/46 |
| 3,118,375 | 1/1964 | Jasse | 102/28 |
| 3,125,954 | 3/1964 | Vilbajo | 102/28 |
| 3,155,553 | 11/1964 | Taylor et al. | 149/21 |
| 3,320,104 | 5/1967 | Stadler et al. | 149/24 |
| 3,793,920 | 2/1974 | Sheran | 86/1 |
| 3,799,055 | 3/1974 | Irish, Jr. et al. | 102/100 |
| 4,070,970 | 1/1978 | Scamaton | 102/28 |
| 4,179,992 | 12/1979 | Ramnarace et al. | 102/45 |
| 4,329,924 | 5/1982 | Lagofun | 102/202.8 |
| 4,402,268 | 9/1983 | Usel | 149/23 |
| 4,522,665 | 6/1985 | Yates | 149/21 |

FOREIGN PATENT DOCUMENTS 812257 4/1959 United Kingdom .

*Primary Examiner*—Stephen J. Lechert, Jr.
*Attorney, Agent, or Firm*—John R. Wahl

[57] ABSTRACT

An electric primer has an intrinsically conductive pyrotechnic mixture consisting of a metal powder fuel, an alkaline oxidizer, and a sensitizing fuel. The primer mixture preferably consists of about 27% titanium metal powder, about 68% potassium chlorate, and 5% boron as the sensitizing fuel. Lead thiocyanate may also be added as a further sensitizing fuel. The primer is advantageously adapted for use in airbag inflators in an automobile passive restraint system.

17 Claims, 1 Drawing Sheet

ELECTRIC PRIMER WITH INTRINSIC CONDUCTIVE MIX

Figure 1:
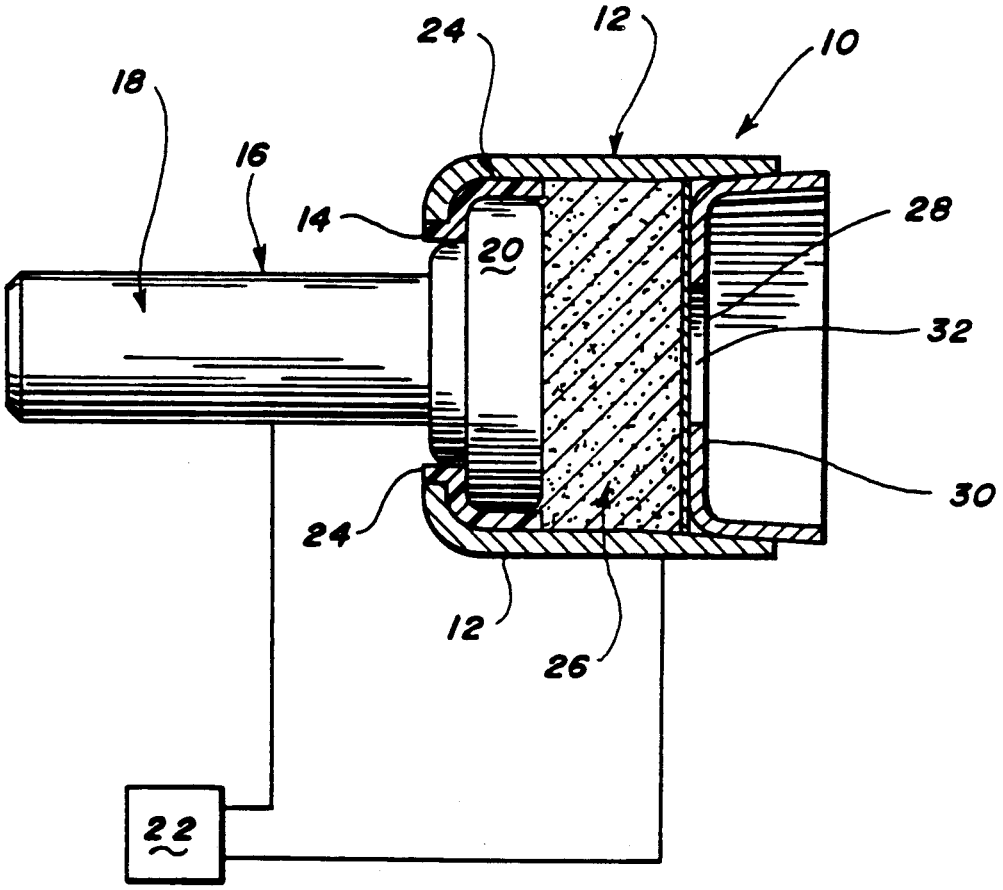

This invention generally relates to electrical primers and more particularly to an electrical primer adapted for use in automotive airbag inflators.

Many types of electric primers are known. These electric primers generally fall into two categories. The first involves the use of a bridge wire in conjunction with an explosive primer mixture. In this type, an applied voltage causes the bridge wire to resistively heat to a point where ignition occurs. Another variation of the bridge wire device is an exploding bridge wire primer. In this device the voltage applied is high enough to cause almost instantaneous vaporization of the bridge wire creating a plasma. The shock wave produced by this plasma detonates a high explosive. These devices are relatively insensitive to low shock levels, but have the disadvantage of requiring a relatively large and cumbersome voltage source.

The second type of electric primer involves the use of an explosive primer mixture having a conductive substance such as noble metal filings, noble metal powder, or some form of carbon mixed therein to provide many small conduction paths. Like the bridge wire primer, a current passing through the conducting powder causes localized heating and/or a spark which in turn detonates the explosive primer mixture.

In the case of bridge wire devices, the bridge wire can tolerate a generally high amount of radio frequency (RF) radiation or electrostatic discharge (ESD) stimulus. However, bridge wire devices have a tendency to burn without detonating the explosive mix thus causing misfires. To remedy this, redundancy is usually employed requiring a multitude of bridge wires in contact with the mixture. This substantially increases the manufacturing problems. Secondly, bridge wire devices require more parts and more steps to assemble and thus are more costly to produce than conductive mix type devices.

In contrast, the prior art conductive mix type primers provide an enormous number of redundant electrically conductive paths and thus theoretically may be much more reliable. Electric primers utilizing a conductive mixture composition generally includes an explosive component and a finally divided noble metal powder or carbon black. One such patent is U.S. Pat. No. 3,090,310 issued to Peet et al. The conductive mixture in Peet et al comprises zirconium, zirconium hydride, barium nitrate, lead peroxide, and pentaethyeride tetranitrate (PETN). This is an explosive primer mixture having a substantial percentage of PETN, approximately 20%. This mixture also requires a substantial input of total energy for detonation.

Other examples of electric primers utilizing conductive mixtures are those described in U.S. Pat. Nos. 3,793,920, 3,320,164, and 3,155,553. These patents each disclose a composition having primarily a finely divided detonating material such as lead azide or other explosive and either carbon in some form or a finely divided noble metal powder. These metals and carbon act as conductors and do not act primarily as a fuel and therefore their content is minimized in order to achieve the desired results.

Since these mixtures contain primarily initiating explosives such as lead styphnate or lead azide, there is a substantial explosive hazard during manufacture and handling. In addition, when designed to operate at relatively low voltages, immunity to radio frequency radiation and electrostatic discharge is minimal.

A conductive mixture without an explosive utilized in an electric primer is disclosed in U.S. Pat. No. 4,070,970 issued to Scamaton. This patent discloses an electric ignitor having good resistance to low voltage accidental triggering. However, the mixture requires a relatively high initiation voltage and relies upon breakdown of the dielectric presented by copper oxide. The mixture disclosed in this patent is a mixture of copper oxide and aluminum powder, which is a thermite mixture, having a pre-breakdown DC resistance of at least 1 megohm. Thus, the voltage required for operation of this ignitor is substantial. In fact, this mixture requires an applied voltage of approximately 1700 volts to achieve dielectric breakdown and ignition. Accordingly, this mixture is not useful at low voltages.

U.S. Pat. No. 4,522,665, issued to Yates et al, discloses a percussive priming mixture whose composition is similar to that of the present invention. However, this patent teaches the use of a mixture of titanium and potassium perchlorate not in an electric primer application, but in a percussive primer where a substantial level of impact energy is required for ignition. The Yates Patent does not teach the use of titanium and potassium chlorate in electric primer applications at low voltages. In fact, U.S. Pat. No. 4,522,665 specifically teaches that this mixture requires the use of a separate electrical heating element for electrical ignition, as in bridge wire primers.

The electrically conductive primer mixtures of the prior art are not found to be entirely satisfactory for use in automotive airbag inflators for several reasons. First, the firing voltage threshold required in an automotive application is preferably on the order of 9 to 12 volts. Most prior art electric primers require voltages on the order of 80 volts or higher. At lower voltages, the prior art primer mixtures are generally overly sensitive to discharge of stray electrostatic energy. In addition, the presence of an explosive material such as lead styphnate and lead azide is undesirable. The hazard of manufacturing and handling these explosives is substantial. Accordingly, a mixture which minimizes or eliminates the use of explosive materials is advantageous for use in airbag inflators in automotive passive restraint systems.

It is therefore an object of the present invention to provide an intrinsically conductive pyrotechnic mix for an electric primer without utilizing a separate heating element such as a bridge wire or non-reactive metal powder.

It is another object of the present invention to provide an intrinsically conductive mix primer without utilizing a primarily explosive component.

It is another object of the present invention to provide an intrinsic conductive mix primer which operates reliably at low voltages.

It is another object of the present invention to provide an intrinsically conductive pyrotechnic mix primer that has a reduced sensitivity to RF radiation and ESD.

It is still another object of the present invention to provide an electric primer utilizing an intrinsically conductive mixture to reliably ignite the propellant in a gas generator utilized in an airbag inflator for an automotive passive restraint system.

These and other objects of the present invention are advantageously achieved in an electric primer using an intrinsic conductive pyrotechnic mixture according to the present invention consisting essentially of about 15% to 50% dry weight of a finely divided metal powder fuel, about 75% to 40% dry weight of an alkaline oxidizer, and about 2% to 15% dry weight of at least one secondary sensitizing fuel mixed together. The mixture may also include a binder to hold the mixture together in certain applications.

The mixture may be compacted to establish particular desired resistivity values, total energy required for ignition and predictable repeatability values that may be required for a specific design.

The metal fuel in the mixture according to the present invention may be any oxidizable metal powder which can serve as the primary fuel and provide a conductive path for electrical current through the mixture. More specifically, the metal powder fuel is preferably selected from the group consisting essentially of titanium, zirconium, uranium, and aluminum. A specifically preferable metal powder fuel for use in the mixture of the invention for application in automotive airbag inflator electric primers is titanium.

The alkaline oxidizer advantageously utilized in the mixture according to the present invention may be an alkaline oxidizer selected from the group consisting essentially of an alkali metal or an alkaline earth metal chlorate or perchlorate. Both chlorates and perchlorates must be used with care as they are very reactive and verge on being an explosive themselves. Illustrative examples in this group include potassium, sodium, and calcium chlorate. More specifically, a preferred oxidizer for use in the mixture of the invention for automotive airbag inflator primers is potassium chlorate.

The secondary fuel and sensitizer utilized in the mixture of the present invention is preferably selected from the group consisting essentially of boron, sulphur, and lead thiocyanate. One specifically preferable sensitizer for the mixture of the invention for automotive airbag inflator primers is boron. Alternatively, another preferred embodiment of the mixture of the invention includes both boron and lead thiocyanate as secondary fuel sensitizers.

One preferred embodiment of the intrinsic conductive mixture according to the present invention consists of essentially titanium metal powder in about 27% dry weight, potassium chlorate in about 68% dry weight, and 5% dry weight of boron as the secondary fuel and sensitizer.

In order to obtain repeatability and specific desired resistance and total energy input values in a particular design application, the mixture according to the present invention is compacted to at least 1000 psi. Compaction ensures that the mixture is in firm electrical contact with the electrodes used to pass electrical current through the primer mixture to cause ignition. Preferably, for applications at low voltages such as are utilized in automobiles, the mixture is compacted at a pressure of between about 3000 psi and 150,000 psi using conventional primer mix compaction techniques.

The electric primer with an intrinsic conductive pyrotechnic mix in accordance with the present invention is advantageously designed for igniting a propellant in a gas generator which is in turn utilized in an automatic airbag inflator for an automobile passive restraint system. The electric primer includes a cup shaped outer electrode having a central bore through the bottom of the cup and an inner button shaped electrode disposed within the cup and spaced from the outer electrode. The inner electrode has a terminal portion extending through the bore, out of the cup for external connection to an electrical power source, typically the vehicle battery. An insulator sleeve is placed between the button portion of the inner electrode and the outer electrode thus spacing and separating the electrodes from one another.

The pyrotechnic mixture in accordance with the present invention, as described above, of a metal powder fuel, an alkaline oxidizer, and a sensitizing fuel are compacted together of a pressure of preferably about 3000 psi within the cup for consistent repeatability. The mixture is positioned and compressed against the button and the inner wall of the outer cup electrode so as to span the insulator. In this configuration the primer exhibits a resistance of about 5 ohms.

The electric primer is ignited by impressing nominal vehicle battery voltage of 9 to 11 volts across the two electrodes. This impressed voltage causes a current to flow through the conductive mix, igniting the mix, and thus causes ignition of a propellant such as sodium azide within the gas generator.

The intrinsic conductive pyrotechnic mixture according the present invention may contain metal fuels from the group of titanium, zirconium, uranium, and aluminum. The oxidizer may be an alkaline metal chlorate or alkaline earth metal chlorate or perchlorate. The perchlorates must be used with care, however, as they are extremely reactive and verge on being an explosive.

The third ingredient, usually a fuel used to supplement the metal fuels when a higher resistance is desired, can be boron, sulphur, or lead thiocyanate. The mixture is consolidated by application of a force between 3000 psi and 150,000 psi. The magnitude of consolidation pressures applied affects the thermal stability and the ignition sensitivity of the mix as well as the repeatability and hence reliability of the assembly.

These and other objects, features and advantages of the present invention will become readily apparent upon consideration of the following detailed description when taken in conjunction with the drawing and appended claims.

FIG. 1 is a sectional view of one preferred embodiment of an electric primer in accordance with the present invention.

Turning now the drawing, an electric primer 10 according to a preferred embodiment of the present invention is shown FIG. 1. The electric primer 10 is utilized in a gas generator for an automatic airbag inflator (not shown) in an automobile passive resistant system. The electric primer 10 is operative at a nominal vehicle battery voltage to ignite a propellant such as sodium azide within the gas generator.

Electric primer 10 includes a cup shaped tubular outer electrode body 12 made of a conductive metal such as copper, brass, steel, or aluminum. The cup shaped body 12 has a central bore 14 through the bottom of the cup body 12. An inner electrode 16 having a terminal stud portion 18 and a button portion 20 is positioned in cup 12 with the terminal stud portion 18 extending out of cup 12 through bore 14. A power supply 22 such as a vehicle battery or a charged capacitor bank is shown schematically externally connected to stud portion 18 and outer cup 12. The power supply 22 applies a voltage across electrodes 12 and 16 to cause electrical current to flow between the electrodes, as described below. The power supply has a nominal voltage between 9 and 12 V DC.

Spaced between and separating button portion 20 of inner electrode 16 from outer electrode 12 is an insulator 24. Insulator 24 may be a ceramic, plastic, or glass material and is sleeve shaped so as to space the disk shaped button portion 20 internally from the cup shaped outer electrode 12.

Placed within the cup shaped outer electrode 12 and against the button portion 16 is an intrinsically conductive pyrotechnic mixture 26 in accordance with the present invention. This mixture consists essentially of a powdered metal fuel, an alkaline chlorate oxidizer, and at least one secondary fuel which acts as a sensitizer. The presence of a fuel sensitizer fine tunes the firing threshold of the mixture as will be subsequentially described.

Against the mixture 26 is a closure wad 28. This closure wad 28 may be made of any suitable material such as paper, nitrocellulose, or cellulose acetate. The primary purpose of wad 28 is to retain the mixture in the cup 12 and separate the primer mixture from the propellant to be ignited (not shown). Frictionally disposed in cup shaped outer electrode 12 and against closure wad 28 is a support cup 30 which has a centrally located flash hole 32 therethrough for use as a flame exit. The support cup 30 prevents the outer electrode body 12 from collapse when the electrical primer is pressed into a metal cavity (not shown) in the cartridge or gas generator casing. The support cup 30 is frictionally secured within the outer cup 12. Thus the conductive mixture 26 is packaged between outer cup 12, button portion 20, and support cup 30.

The intrinsic conductive mixture in accordance with the present invention preferably includes a metal powder fuel, an alkaline chlorate oxidizer, and at least one secondary fuel which acts as a sensitizer to adjust the firing potential of the mixture. A preferred embodiment of this mixture consists essentially of titanium metal powder, potassium chlorate, and either boron or lead thiocyanate as a sensitizer fuel.

This mixture is a pyrotechnic mixture and does not include primarily any explosive or other material that is susceptible to independent detonation. The metal fuel may be from the group consisting of titanium, zirconium, uranium and aluminum. The alkaline oxidizer may be from the group comprising potassium chlorate, sodium chlorate, and calcium chlorate. The secondary fuel may be boron, sulphur, or lead thiocyanate.

The intrinsic conductive mixture, including titanium, potassium chlorate, and boron is preferably formulated with 20–45% titanium powder 75–40% potassium chlorate, and 2–15% secondary fuel sensitizer. In addition, a binder material of 1–3% dry weight may be added. Finally, an additional fuel sensitizer may be utilized, such as lead thiocyanate, to further adjust the sensitivity and firing threshold of the mix for a particular design and for a given temperature range.

One exemplary preferred embodiment of the mixture comprises 27% dry weight titanium powder, 68% dry weight potassium chlorate, and 5% dry weight boron. This composition compacted to at least 3000 psi ignites readily when a voltage of 9–12 volts is applied to the electrodes 12 and 16 by the power supply 22. This power supply may be vehicle battery or may be a separate source of DC voltage and current according to a particular inflator design. An optimum DC resistance of this mixture has been found to be about 5 ohms in vehicle airbag inflator applications.

In addition to the three major constituents of the mixture, a binder may be added to bind the mixture together. Finally, more than one sensitizer such as lead thiocyanate may be utilized in small amounts to fine tune or adjust the sensitivity of the mixture.

The intrinsically conductive mixture in accordance of the present invention is compacted within the outer cup 12 after assembly of the inner electrode 16 and insulator 24 therein. The mixture 26 is compacted under a pressure ranging from about 3000 psi to 150,000 psi. The compaction pressure significantly affects the energy required to initiate mixture ignition. For example, the energy required for is approximately 0.272 Joules at 3000 psi and approximately 0.9 Joules at 150,000 psi.

The presence of a secondary fuel sensitizer such as boron and/or lead thiocyanate is not absolutely necessary for ignition of the intrinsically conductive mixture according to the present invention. However, the presence of one or more of these sensitizers lowers the total energy required for ignition. However, the total energy required is substantial and provides a low sensitivity to RF radiation and ESD even when the resistance is about 5 ohms. For example, the mixture including 5% boron readily ignites when subjected to an applied voltage of 12 volts. In contrast, a mixture without any sensitizer requires a substantially higher voltage level for ignition, on the order of 24 volts.

Unlike prior art conductive mixes, the metal component in the mixture of the present invention not only serves as a conductive material but also serves as the major fuel. In addition, no primary explosive is used in the mixture according to the present invention.

The voltage sensitivity of the mixture is not significantly effected by the absence of a secondary fuel or sensitizer. Only the total energy required to ignite the fuel and oxidizer of the mixture is greater where the sensitizer is absent. Moreover, the total energy required to ignite the fuel and oxidizer in the mixture is high while the resistance is low, which permits the use of the mixture at relatively low voltages.

The electric primer utilizing an intrinsically conductive pyrotechnic mixture consisting essentially of a metal powder fuel, an alkaline metal oxidizer, and at least one sensitizer fuel in accordance with the present invention may also be advantageously used in other electric primer applications than that specifically described herein. For example, the primer mixture of the present invention may be used in many electric primer applications where stable mixtures and low operating voltage thresholds are required. What has been described is a preferred embodiment of the invention. Variations and equivalents are within the scope of the present invention. The foregoing description is to be clearly understood as being given by way of illustration and example only. The spirit and scope of this invention is intended to be limited only by the scope of the following appended claims.

What is claimed is:

1. An electric primer comprising an intrinsically conductive pyrotechnic mixture consisting essentially of 15% to 50% dry weight of a finely divided metal powder fuel, 75% to 40% dry weight of an alkaline oxidizer, and 2% to 15% of a sensitizing fuel.

2. The mixture according to claim 1 wherein the mixture is compacted together under a pressure of at least 1000 pounds per square inch.

3. The mixture according to claim 2 wherein the mixture is compacted together under a pressure of between about 3000 to 150,000 pounds per square inch.

4. The mixture according to claim 2 wherein said alkaline oxidizer is selected from the group consisting of an alkali metal or an alkaline earth metal chlorate or perchlorate.

5. The mixture according to claim 2 wherein said metal powder fuel is selected from the group consisting of titanium, zirconium, uranium, and aluminum.

6. The mixture according to claim 4 wherein said metal powder fuel is titanium.

7. The mixture according to claim 5 wherein said alkaline oxidizer is selected from the group consisting of potassium chlorate, sodium chlorate, sodium chlorate and calcium chlorate.

8. The mixture according to claim 7 wherein said oxidizer is potassium chlorate.

9. The mixture according to claim 7 wherein said oxidizer is potassium perchlorate.

10. The mixture according to claim 4 wherein said metal powder fuel is selected from the group consisting of titanium, zirconium, uranium, and aluminum.

11. The mixture according to claim 8 wherein said metal powder fuel is titanium.

12. The mixture according to claim 2 wherein said sensitizing fuel is boron.

13. The mixture according to claim 2 wherein said metal powder is about 27% dry weight.

14. The mixture according to claim 13 wherein said oxidizer is about 68% dry weight.

15. The mixture according to claim 14 wherein said mixture is compacted a pressure between 3000 psi and 150,000 psi.

16. The mixture according to claim 2 wherein said fuel sensitizer is lead thiocyanate.

17. The mixture according to claim 3 wherein said metal powder fuel is about 27% dry weight titanium, said alkaline oxidizer is about 68% dry weight potassium chlorate, and said sensitizer is about 5% dry weight boron.

* * * * *

UNITED STATES PATENT AND TRADEMARK OFFICE

CERTIFICATE OF CORRECTION

PATENT NO. : 4,994,125

DATED : February 19, 1991

INVENTOR(S) : George C. Mei

It is certified that error appears in the above—identified patent and that said Letters Patent is hereby corrected as shown below:

At Column Column 1, line 46, after "and a", delete "finally" and insert --finely--.

At Column 4, line 46, after "now", insert --to--.

At Column 4, line 48, after "shown, insert --in--.

At Column 6, line 6, after "accordance", delete "of" and insert --with--.

At Column 6, line 14, after "for", insert --ignition--.

At Column 7, Claim 7, line 3, after "sodium chlorate", delete second occurrence of "sodium chlorate".

At Column 8, Claim 15, line 2, after "compacted", insert --at--.

Signed and Sealed this

Eighteenth Day of August, 1992

*Attest:*

DOUGLAS B. COMER

*Attesting Officer*

*Acting Commissioner of Patents and Trademarks*